US011450300B1

(12) United States Patent
Chen

(10) Patent No.: US 11,450,300 B1
(45) Date of Patent: Sep. 20, 2022

(54) DRUM HOOP FASTENING DEVICE

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 17/223,530

(22) Filed: Apr. 6, 2021

(51) Int. Cl.
*G10D 13/02* (2020.01)
*G10D 13/16* (2020.01)

(52) U.S. Cl.
CPC ..... *G10D 13/16* (2020.02); *G10D 13/02* (2013.01)

(58) Field of Classification Search
CPC ..... G10D 13/16; G10D 13/02; G10D 13/00
See application file for complete search history.

(56) References Cited

U.S. PATENT DOCUMENTS

2015/0161974 A1* 6/2015 Martin ..... G10D 13/02 84/413

* cited by examiner

*Primary Examiner* — Kimberly R Lockett
(74) *Attorney, Agent, or Firm* — Muncy, Geissler, Olds & Lowe P.C.

(57) ABSTRACT

A drum hoop fastening device is provided. The drum hoop fastening device is configured to be disposed on a drum, and the drum includes a drum shell and a drum hoop disposed on the drum shell. The drum hoop fastening device includes: a main body and a filler. The main body is configured to be disposed on the drum shell and includes an inner space, at least one fastening member and at least one restricting member being blockable with the at least one fastening member. Each of the at least one fastening member is configured to be connected with a fastener disposed through the drum hoop so that the drum hoop is restricted to the drum shell. The filler is received within the inner space.

10 Claims, 8 Drawing Sheets

DRUM HOOP FASTENING DEVICE

BACKGROUND OF THE INVENTION

Field of the Invention

The present invention relates to a drum hoop fastening device.

Description of the Prior Art

Generally, a drum includes a drum shell which is hollow, two drumheads covering two openings of the drum shell and two drum hoops respectively covering the two drumheads. A plurality of fastening members are attached to the drum shell, and a plurality of bolts are respectively disposed through a plurality of through holes of the two drum hoops and screwed with the plurality of fastening members. Therefore, tightness of the two drumheads are adjustable by screwing the plurality of bolts to change a position of the two drum hoops relative to the drum shell so as to adjust a sound and a tune produced when the two drumheads are hit.

Conventionally, each of the plurality of fastening members has an inner chamber for easy manufacturing, assembling and light weight. However, the inner chamber is easy to produce resonance during drumming, and components disposed in the inner chamber are easy to produce noise due to vibration, which causes the sound and the tune of the drum change.

The present invention is, therefore, arisen to obviate or at least mitigate the above-mentioned disadvantages.

SUMMARY OF THE INVENTION

The main object of the present invention is to provide a drum hoop fastening device which avoids producing noise during drumming and is low cost.

To achieve the above and other objects, the present invention provides a drum hoop fastening device, configured to be disposed on a drum. The drum includes a drum shell and a drum hoop disposed on the drum shell. The drum hoop fastening device includes a main body and a filler. The main body is configured to be disposed on the drum shell and includes an inner space, at least one fastening member and at least one restricting member being blockable with the at least one fastening member. Each of the at least one fastening member is configured to be connected with a fastener disposed through the drum hoop so that the drum hoop is restricted to the drum shell. The filler is received within the inner space.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
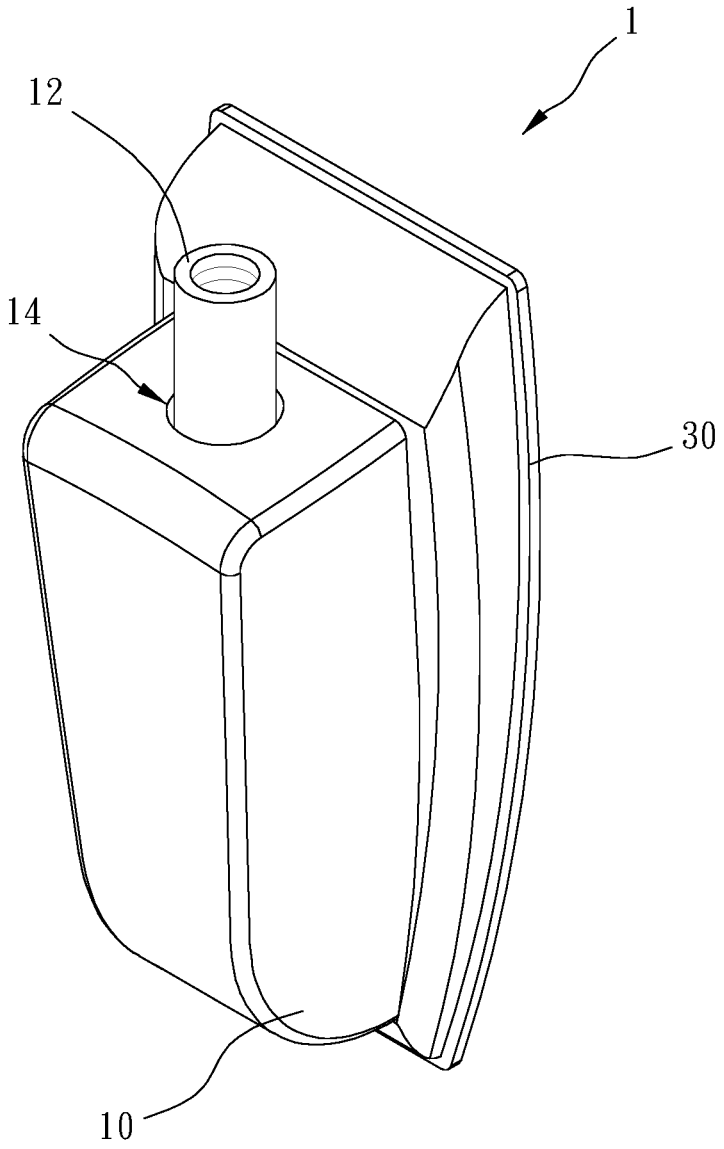
FIG. 1 is a stereogram of a preferable embodiment of the present invention.
Figure 2:
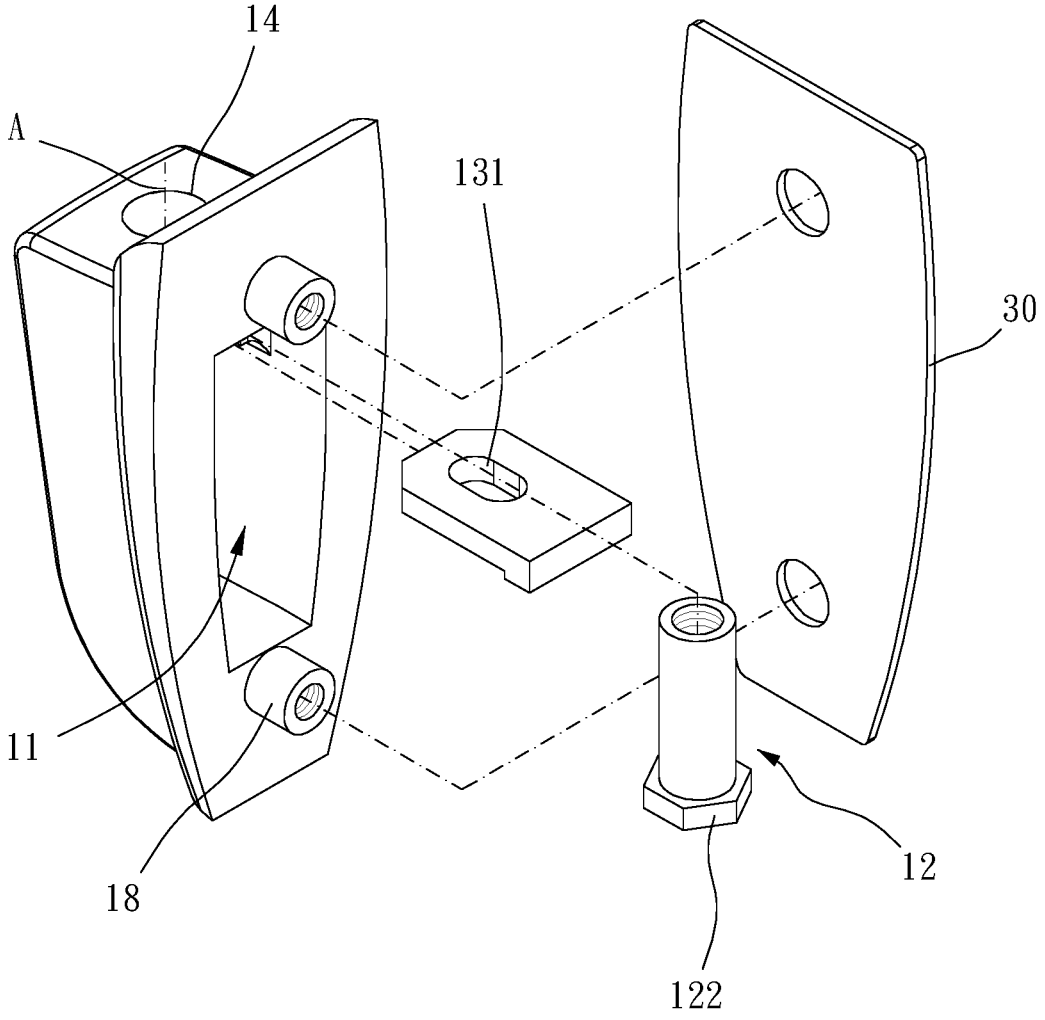
FIG. 2 is a partial breakdown drawing of a preferable embodiment of the present invention.

Please refer to FIGS. 1 to 8 for a preferable embodiment of the present invention. A drum hoop fastening device 1 of the present invention is configured to be disposed on a drum 100, and the drum 100 includes a drum shell 110 and a drum hoop 120 disposed on the drum shell 110. The drum hoop fastening device 1 includes: a main body 10 and a filler 20.

The main body 10 is configured to be disposed on the drum shell 110 and includes an inner space 11, at least one fastening member 12 and at least one restricting member 13 being blockable with the at least one fastening member 12. Each of the at least one fastening member 12 is configured to be connected with a fastener 130 disposed through the drum hoop 120 so that the drum hoop 120 is restricted to the drum shell 110. The filler 20 is received within the inner space 11 so as to avoid noise produced by the drum hoop fastening device 1 during drumming, and the drum hoop fastening device 1 is low cost and lightweight.

Figure 3:
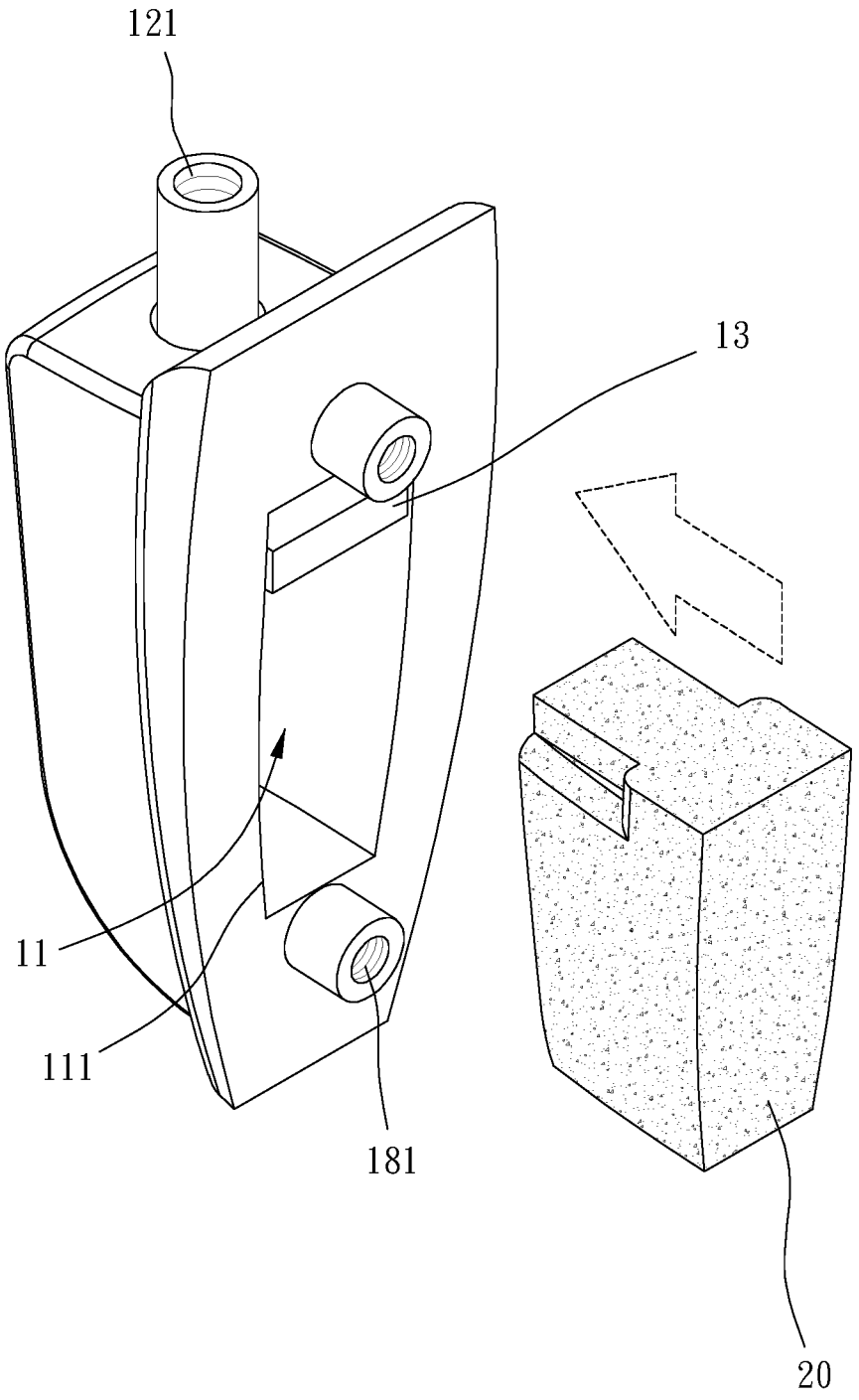
FIGS. 3-5 are schematic diagrams showing assembling according to a preferable embodiment of the present invention.
Figure 4:
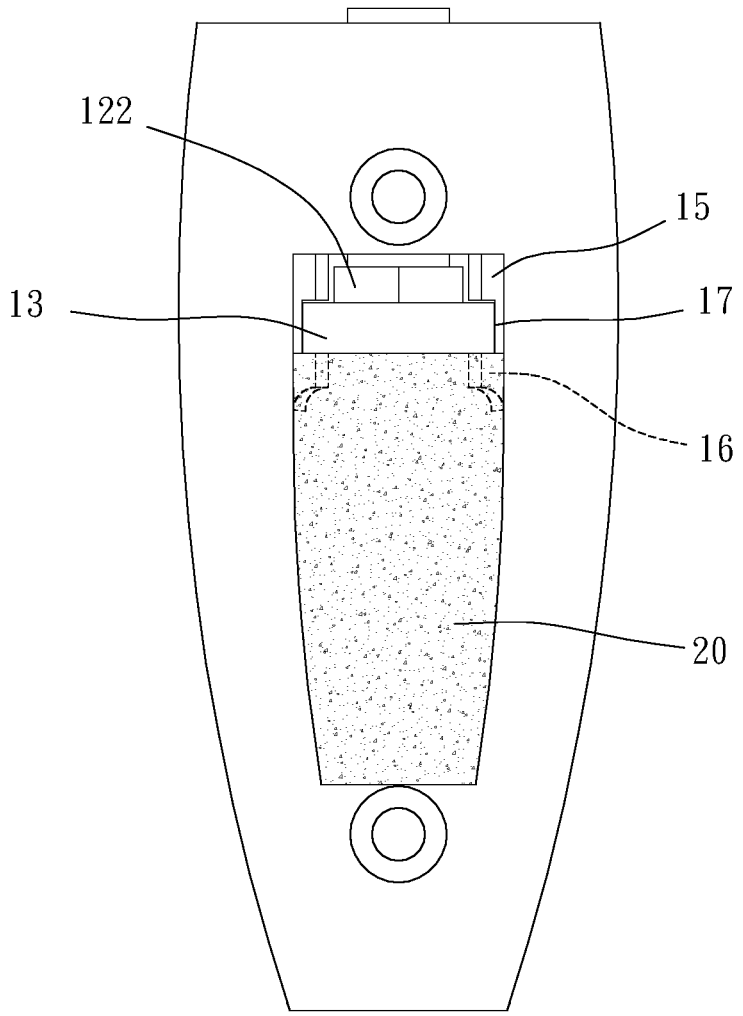
Figure 5:
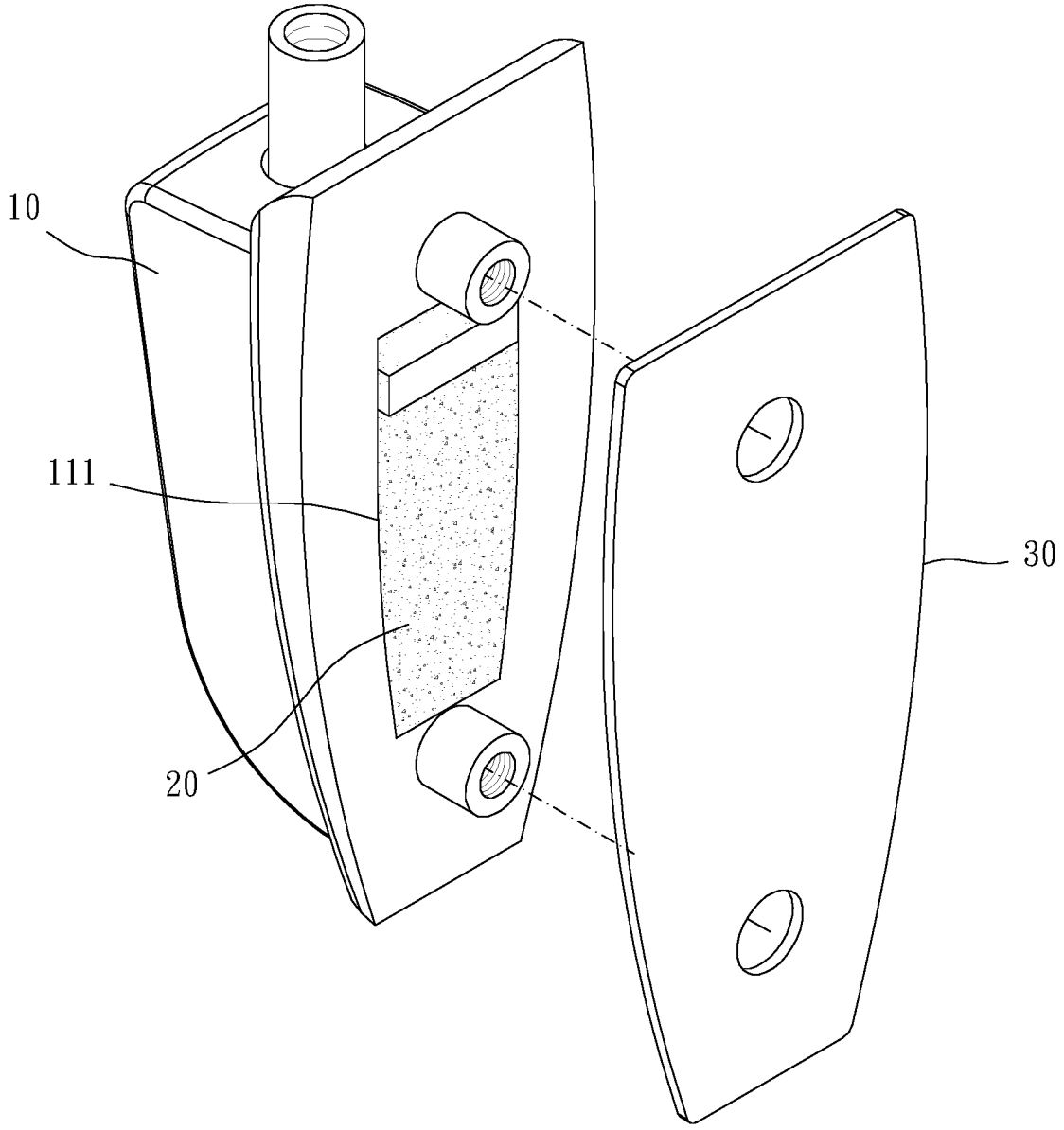

A volume of the filler 20 occupies at least ½ of the inner space 11 so as to effectively avoid resonance; a shape of the filler 20 at least partially corresponds to a shape of the inner space 11 so as to avoid movement of the filler 20 during drumming. In this embodiment, the drum hoop fastening device 1 further includes a cushion member 30 covering an opening 111 of the inner space 11, and the cushion member 30 is at least partially contacted with the filler 20 for stable assembling. The cushion member 30 is preferably made of plastic, rubber, silicone, or other shock-absorbing materials so that the cushion member 30 can absorb vibrations from the drum shell 110 and reduce collision between components. Please refer to FIGS. 3 to 5, the volume of the filler 20 preferably occupies at least ⅔ of the inner space 11, and the filler 20 is flush with the opening 111 so as to reduce relative movement of components. The filler 20 may be made of at least one of plastic, foamed materials, silicone and fiber. In this embodiment, the filler 20 is a preformed plastic with a shape corresponding to the shape of the inner space 11 (as shown in FIG. 3), which is easy to be assembled and replaced. In other embodiments, the drum hoop fastening device may be directly attached to the drum shell without the cushion member; the filler may be made of foamed resin which can fill up the inner space so as to effectively avoid resonance and have advantages of low cost and light weight; the filler may be made of a material which is deformable to fit the shape of the inner space.

Specifically, the main body 10 has at least one through hole 14 extending in an axial direction A, and each of the at least one fastening member 12 is movably disposed through one of the at least one through hole 14 and is blockable by the at least one restricting member 13 in the axial direction A. An end of each of the at least one fastening member 12 has a screwing hole 121 configured for the fastener 130 to be screwed therewithin and protrudes beyond an outer surface of the main body 10; a diametrical dimension of each of the at least one through hole 14 is larger than an outer diametrical dimension of one of the at least one fastening member 12 so that the at least one fastening member 12 is radially movable for easy assembling. Each of the at least one the fastening member 12 includes a head portion 122 being non-circular, and the main body 10 has at least two projections 15 disposed in the inner space 11 and located at two opposite sides of the at least one through hole 14. The head portion 122 of each of the at least one fastening member 12 is located between and circumferentially blockable with two said projections 15, which prevents the at least one fastening member 12 from being rotated when the fastener 130 is rotated. In this embodiment, the restricting member 13 is a plastic cushion which has a slot 131 disposed therethrough and corresponding to the screwing hole 121; the main body 10 further has at least one blocking portion 16 spaced apart from the at least two projections 15, and each of the at least one blocking portion 16 and two said projections 15 define an engaging slot 17 therebetween for receiving the at least one the restricting member 13. Each of the at least one blocking portion 16 may include two ribs extending from an inner wall of the main body 10, which provides a simple structure and is easy to be assembled. In other embodiments, the blocking portion may be a board disposed in the main body; the at least one restricting member may be integrally formed in one piece with the filler so that the drum hoop fastening device can be formed without said restricting member and said blocking portion, which provides a simple structure and is easy to be assembled.

In another embodiment, two opposite sidewalls of the main body respectively have two said through holes, each of the two said through holes has one said fastening member penetrating therethrough so that the drum hoop fastening device can connect two said drum hoops with the drum shell. The at least one restricting member is a spring elastically abutted against and between two said fastening members. The inner space is filled with the filler after the two said fastening members and the spring are assembled therein. The filler may be formed with a space to receive the spring or be deformable to fit the inner space so as to prevent the spring from being vibrated and collided with surrounding components to produce noise.

The main body 10 further includes at least one connecting column 18 lateral to the axial direction A. Each of the at least one connecting column 18 protrudes beyond a side of the main body 10 having the opening 111 disposed thereon and has a threaded hole 181 configured for a screwing member disposed through the drum shell 110 to be screwed therewithin so that the at least one connecting column 18 is configured to be inserted within the drum shell 110 for stable positioning and easy assembling. Preferably, the side of the main body 10 extends arcuately so as to correspond to an outer surface of the drum shell 110 and be stably attached to the drum shell 110. However, the at least one connecting column may not protrude beyond the side of the main body.

Figure 6:
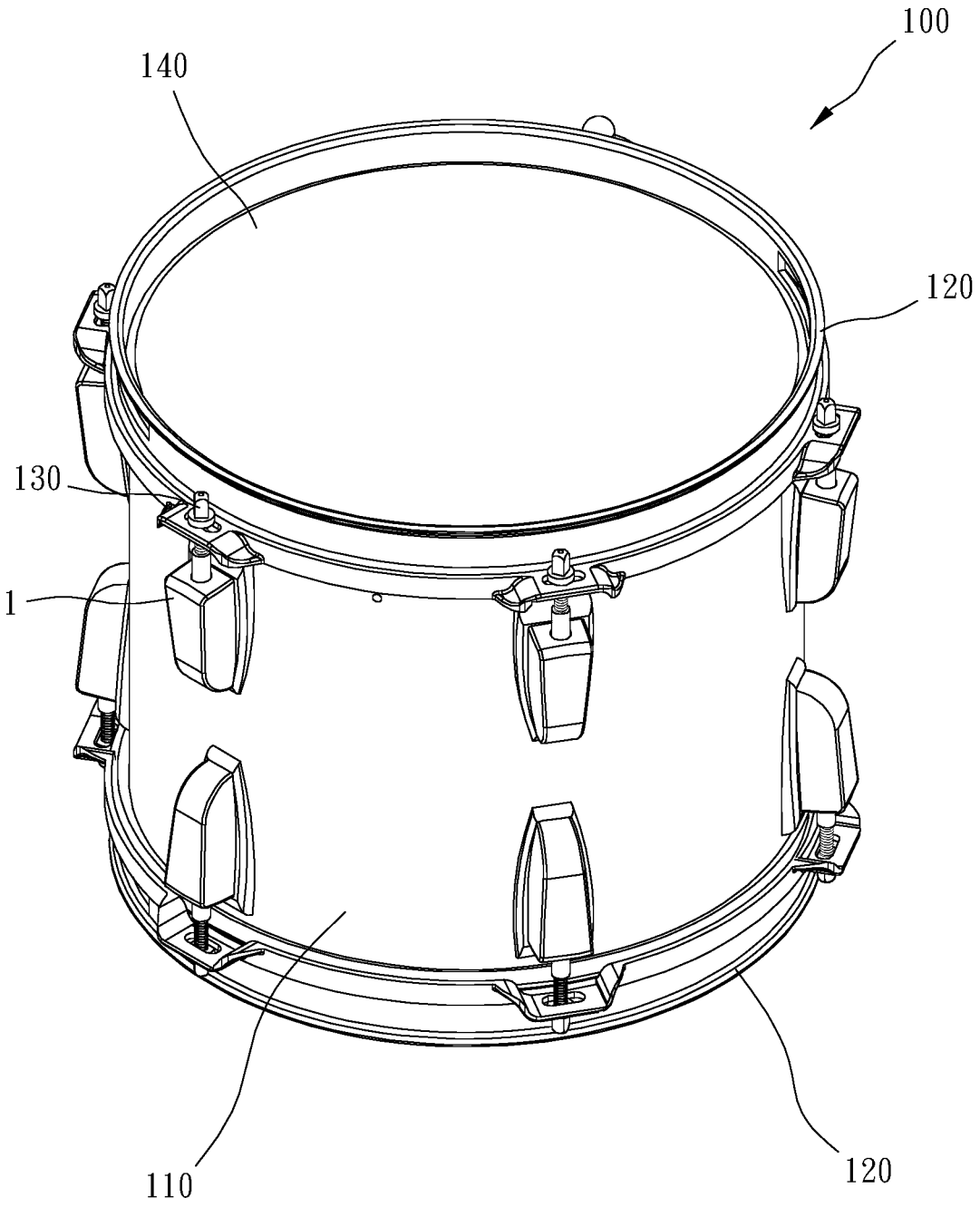
FIGS. 6 and 7 are schematic diagrams showing application according to a preferable embodiment of the present invention.
Figure 7:
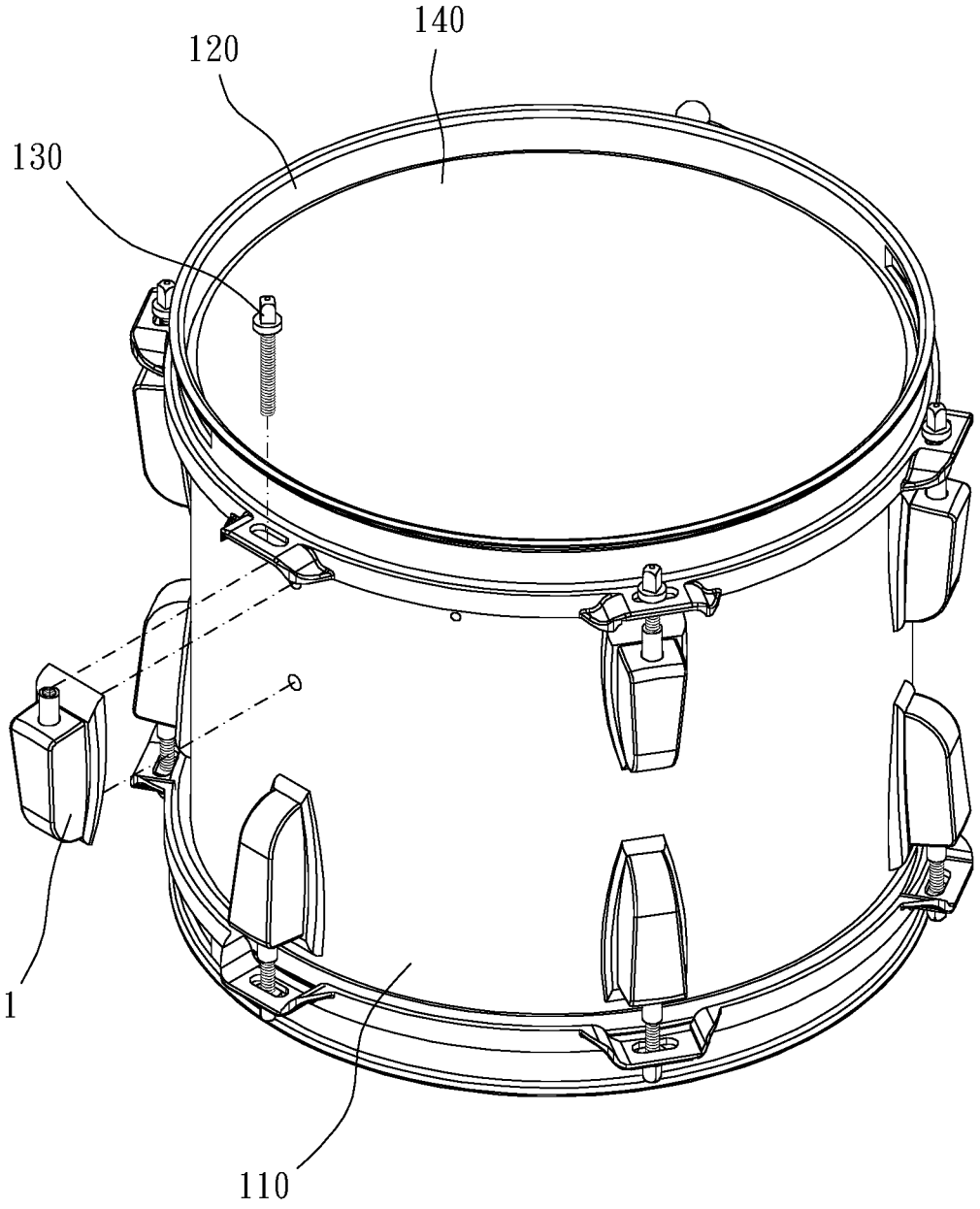
Figure 8:
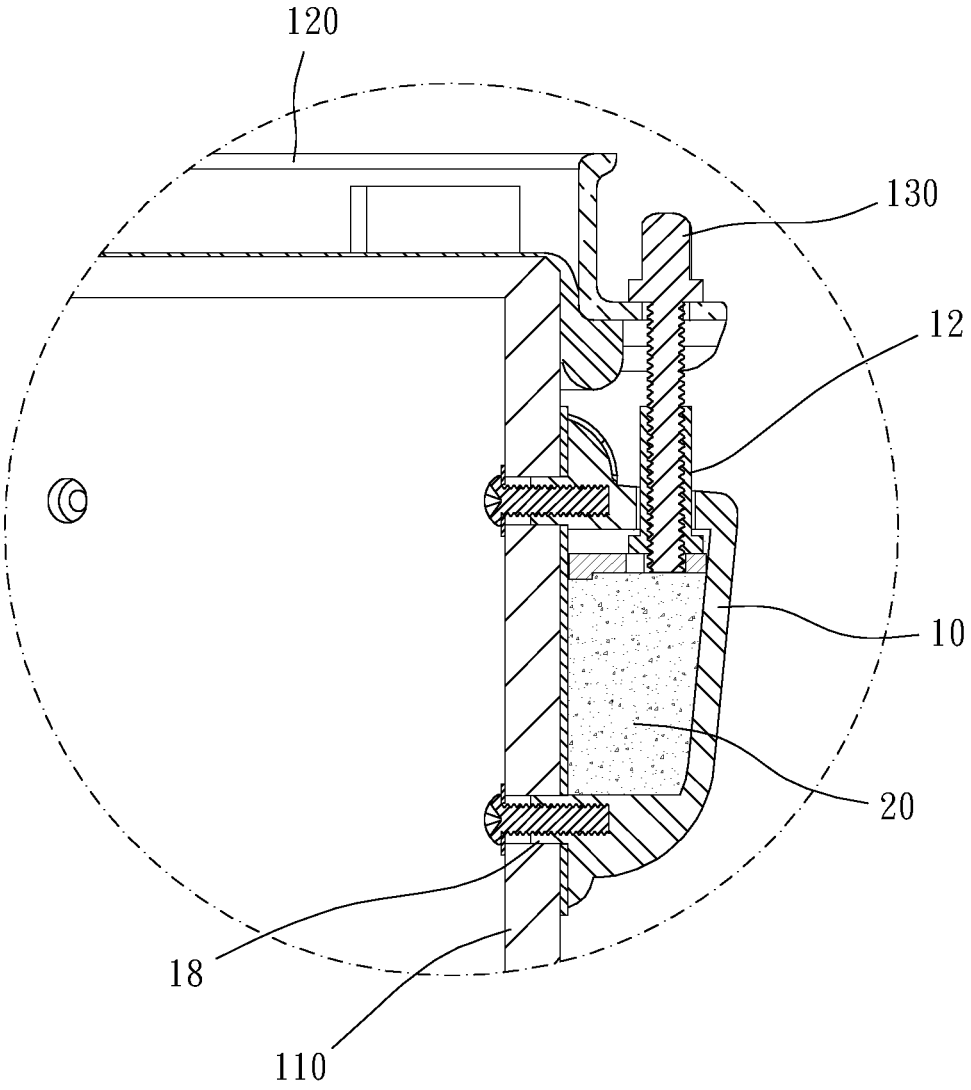
FIG. 8 is a partial cross-sectional view of FIG. 6.

Please refers to FIGS. 6 to 8, in application, a plurality of said drum hoop fastening devices 1 as described above are disposed on an outer circumferential wall of the drum shell 110, and the drum 100 further includes a drumheads 140 covering an opening of the drum shell 110 and disposed between the drum shell 110 and the drum hoop 120. A plurality of said fasteners 130 are respectively disposed through the drum hoop 120 and connected with one said fastening member 12. As shown in FIG. 8, the inner space 11 of each said drum hoop fastening device 1 is filled with the filler 20, which effectively avoids resonance of the inner space 11 and noise caused by vibrations of components during drumming.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A drum hoop fastening device, configured to be disposed on a drum, the drum including a drum shell and a drum hoop disposed on the drum shell, the drum hoop fastening device including:

a main body, configured to be disposed on the drum shell, including an inner space, at least one fastening member and at least one restricting member being blockable with the at least one fastening member, each of the at least one fastening member configured to be connected with a fastener disposed through the drum hoop so that the drum hoop is restricted to the drum shell; and a filler, received within the inner space.

2. The drum hoop fastening device of claim 1, wherein a volume of the filler occupies at least ½ of the inner space.

3. The drum hoop fastening device of claim 1, wherein a shape of the filler at least partially corresponds to a shape of the inner space.

4. The drum hoop fastening device of claim 1, wherein the filler is flush with an opening of the inner space.

5. The drum hoop fastening device of claim 1, further including a cushion member covering an opening of the inner space, wherein the cushion member is at least partially contacted with the filler.

6. The drum hoop fastening device of claim 1, wherein the filler is made of at least one of plastic, foamed materials, silicone, rubber and fiber.

7. The drum hoop fastening device of claim 1, wherein the main body has at least one through hole extending in an axial direction, each of the at least one fastening member is movably disposed through one of the at least one through hole and is blockable by the at least one restricting member in the axial direction, and an end of each of the at least one fastening member has a screwing hole configured for the fastener to be screwed therewithin and protrudes beyond an outer surface of the main body.

8. The drum hoop fastening device of claim 7, wherein each of the at least one fastening member includes a head portion being non-circular, the main body has at least two projections disposed in the inner space and located at two opposite sides of the at least one through hole, and the head portion of each of the at least one fastening member is located between and circumferentially blockable with two said projections.

9. The drum hoop fastening device of claim 1, wherein the at least one restricting member is integrally formed in one piece with the filler.

10. The drum hoop fastening device of claim 8, wherein a volume of the filler occupies at least ⅔ of the inner space; a shape of the filler at least partially corresponds to a shape of the inner space; the drum hoop fastening device further includes a cushion member covering an opening of the inner space, the cushion member is at least partially contacted with the filler; the filler is made of at least one of plastic, foamed materials, silicone, rubber and fiber; the filler is flush with the opening; the main body further has at least one blocking portion spaced apart from the at least two projections, each of the at least one blocking portion and two said projections define an engaging slot therebetween for receiving the at least one restricting member; the main body further includes at least one connecting column lateral to the axial direction, and each of the at least one connecting column protrudes beyond a side of the main body having the opening disposed thereon and has a threaded hole configured for a screwing member disposed through the drum shell to be screwed therewithin.

* * * * *